US011835307B2

(12) United States Patent
Mantha et al.

(10) Patent No.: US 11,835,307 B2
(45) **Date of Patent: *Dec. 5, 2023**

(54) APPLYING COATINGS TO THE INTERIOR SURFACES OF HEAT EXCHANGERS

(71) Applicant: Rheem Manufacturing Company, Atlanta, GA (US)

(72) Inventors: Divakar Mantha, Montgomery, AL (US); Troy E. Trant, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 30 days.

This patent is subject to a terminal disclaimer.

(21) Appl. No.: 17/364,962

(22) Filed: Jul. 1, 2021

(65) Prior Publication Data

US 2021/0404754 A1 Dec. 30, 2021

Related U.S. Application Data

(63) Continuation of application No. 16/382,717, filed on Apr. 12, 2019, now Pat. No. 11,054,199.

(51) Int. Cl.
*F28F 19/06* (2006.01)
*C23C 8/16* (2006.01)
(Continued)

(52) U.S. Cl.
CPC ..... *F28F 19/06* (2013.01); *C23C 18/163* (2013.01); *C23C 18/1616* (2013.01);
(Continued)

(58) Field of Classification Search
CPC ..... F28F 19/02–06; C23C 18/1616; C23C 18/163; C23C 18/1827; B05C 7/04
See application file for complete search history.

(56) References Cited

U.S. PATENT DOCUMENTS 3,077,421 A 2/1963 Budininkas
3,435,894 A 4/1969 Maddocks
(Continued)

FOREIGN PATENT DOCUMENTS

DE 69303373 T2 1/1997
DE 19816325 A1 10/1999
(Continued)

OTHER PUBLICATIONS

Q. Zhao, Y. Liu, "Investigation of graded Ni—Cu—P-PTFE composite coatings with antiscaling properties," Applied Surface Science, vol. 229, pp. 56-62, 2004.
(Continued)

*Primary Examiner* — Dah-Wei D. Yuan
*Assistant Examiner* — Stephen A Kitt
(74) *Attorney, Agent, or Firm* — Eversheds Sutherland (US) LLP

(57) ABSTRACT

A system for coating an interior surface of a heat exchanger includes a tank for storing the coating solution, a pump, a source line for supplying the coating solution to the heat exchanger, and a return line for returning the remainder of the coating solution to the tank. The system can include a pre-treatment line for supplying a pre-treatment solution to the heat exchanger and a water line for supplying water to the heat exchanger. An air compressor can be coupled to the heat exchanger to force the coating solution, the pre-treatment solution, or the water from the heat exchanger.

20 Claims, 11 Drawing Sheets

(51) Int. Cl.

| | |
|---|---|
| ***C23C 18/18*** | (2006.01) |
| ***F28F 19/02*** | (2006.01) |
| ***C23C 18/16*** | (2006.01) |
| *C23C 18/50* | (2006.01) |
| *C23C 8/50* | (2006.01) |

(52) U.S. Cl.
CPC ..... *C23C 18/1827* (2013.01); *F28F 19/02* (2013.01); *C23C 8/50* (2013.01); *F28F 2245/00* (2013.01)

(56) References Cited

U.S. PATENT DOCUMENTS

| | | | | |
|---|---|---|---|---|
| 3,485,597 | A | 12/1969 | Pearlstein | |
| 4,262,044 | A | 4/1981 | Kuczma, Jr. | |
| 4,616,596 | A * | 10/1986 | Helber, Jr. | C23C 18/1669 118/612 |
| 4,622,917 | A * | 11/1986 | Schramm | C23C 18/1616 118/316 |
| 4,636,255 | A | 1/1987 | Tsuda et al. | |
| 5,397,599 | A | 3/1995 | Chao et al. | |
| 5,897,965 | A | 4/1999 | Itoh et al. | |
| 6,045,860 | A | 4/2000 | Ito et al. | |
| 6,383,661 | B2 | 5/2002 | Wittebrood et al. | |
| 6,500,482 | B1 | 12/2002 | Morcos | |
| 6,509,103 | B1 | 1/2003 | Huffer et al. | |
| 6,513,581 | B1 | 2/2003 | Huffer et al. | |
| 6,617,047 | B1 | 9/2003 | Huffer et al. | |
| 6,685,990 | B1 | 2/2004 | Zhong et al. | |
| 6,783,807 | B2 | 8/2004 | Huffer et al. | |
| 6,790,481 | B2 | 9/2004 | Bishop et al. | |
| 6,948,455 | B2 | 9/2005 | Ferguson et al. | |
| 8,075,957 | B2 | 12/2011 | Kim et al. | |
| 8,152,047 | B2 | 4/2012 | Rottmann | |
| 8,771,790 | B2 | 7/2014 | de Vink | |
| 9,885,347 | B2 | 2/2018 | Lachey et al. | |
| 10,274,239 | B2 | 4/2019 | Kobayashi et al. | |
| 10,731,258 | B2 | 8/2020 | Thottathil et al. | |
| 10,751,821 | B2 | 8/2020 | Gould et al. | |
| 11,085,125 | B2 | 8/2021 | Arumugam et al. | |
| 2001/0047861 | A1 | 12/2001 | Maeda et al. | |
| 2003/0066632 | A1 * | 4/2003 | Bishop | F28F 19/06 165/163 |
| 2003/0098145 | A1 | 5/2003 | Tada et al. | |
| 2004/0258848 | A1 | 12/2004 | Fukunaga et al. | |
| 2006/0222423 | A1 | 10/2006 | Dejong et al. | |
| 2006/0263528 | A1 | 11/2006 | Tiwari | |
| 2006/0283580 | A1 | 12/2006 | Usui | |
| 2007/0235170 | A1 | 10/2007 | Zinck et al. | |
| 2008/0078533 | A1 | 4/2008 | Tolani | |
| 2009/0123777 | A1 | 5/2009 | McComas | |
| 2010/0055422 | A1 | 3/2010 | Kong et al. | |
| 2011/0271937 | A1 | 11/2011 | Knafl et al. | |
| 2012/0118722 | A1 | 5/2012 | Holtzapple et al. | |
| 2013/0122196 | A1 | 5/2013 | Clinton et al. | |
| 2013/0248157 | A1 * | 9/2013 | Zheng | C23C 18/1831 427/230 |
| 2014/0014061 | A1 | 1/2014 | Koskey et al. | |
| 2014/0248432 | A1 | 9/2014 | Franke | |
| 2018/0057942 | A1 | 3/2018 | Yanzhe et al. | |
| 2018/0057944 | A1 | 3/2018 | Mohammadian et al. | |
| 2019/0033020 | A1 | 1/2019 | Twelves, Jr. et al. | |
| 2019/0256979 | A1 | 8/2019 | Sandhage | |
| 2020/0003504 | A1 | 1/2020 | Gage | |
| 2020/0166299 | A1 | 5/2020 | Dobson et al. | |
| 2021/0404754 | A1 | 12/2021 | Mantha et al. | |
| 2022/0065562 | A1 | 3/2022 | Patterson et al. | |
| 2022/0145469 | A1 | 5/2022 | Wojcik et al. | |

FOREIGN PATENT DOCUMENTS

| | | | |
|---|---|---|---|
| EP | 0785296 | B1 | 7/1997 |
| WO | 9323588 | A1 | 11/1993 |
| WO | 2012000236 | A1 | 1/2012 |
| WO | 2014064450 | A1 | 5/2014 |
| WO | 2020/251573 | A1 | 12/2020 |

OTHER PUBLICATIONS

Al-Janabi, et al., "Experimental Fouling Investigation with Electroless Ni—P Coatings," International Journal of Thermal Sciences. 49 (2010) 1063-1071.

International Search Report for PCT/US2020/027372 dated Jul. 23, 2020.

* cited by examiner

APPLYING COATINGS TO THE INTERIOR SURFACES OF HEAT EXCHANGERS

CROSS-REFERENCE TO RELATED APPLICATIONS

This present application is a continuation of U.S. patent application Ser. No. 16/382,717, filed Apr. 12, 2019, the entire disclosure disclosures of which is hereby incorporated herein by reference.

TECHNICAL FIELD

The present disclosure relates generally to systems and methods for applying coatings to the interior surfaces of heat exchangers for water heating devices.

BACKGROUND

Water heaters are generally used to provide a supply of hot water. Water heaters can be used in a number of different residential, commercial, and industrial applications. A water heater can supply hot water for a number of different processes. For example, a hot water heater in a residential dwelling can be used for an automatic clothes washer, an automatic dishwasher, one or more showers, and one or more sink faucets. Water heaters can also be used for heating pools and for a variety of commercial and industrial applications. Water heaters generally input water from a municipal source or from a well. Both of these water sources can include minerals such as calcium and magnesium. The presence of these minerals in water leads to the accumulation of mineral scale deposits ("scaling") on the surfaces of the water heater and downstream appliances. Mineral scale deposits are particularly evident in locations where water is heated, such as in the heat exchanger of a water heater. For example, the rate of mineral scale deposit typically increases at temperatures above 140 degrees F., which is a common temperature range in water heaters. Mineral scale deposits in heat exchangers are a particular problem because the deposits inhibit heat transfer and thus negatively affect the efficiency of the heat exchanger.

Mineral scale deposits can occur in a variety of water heaters, including both tank water heaters and tankless water heaters. Water treatment compositions can be added to water heaters to ameliorate the occurrence of mineral scaling deposits, however, these compositions typically require monitoring and replenishment over time as well as adding cost to the maintenance of the water heater. Accordingly, other solutions to the problems associated with mineral scale deposits are desirable.

SUMMARY

In general, in one aspect, the disclosure relates to a system for coating an interior surface of a heat exchanger where the heat exchanger is not immersed in a tank of the coating solution. The system comprises a tank for storing a coating solution, the tank attached to a source line and a return line; and a pump coupled to the tank, the pump configured to force the coating solution from the source line, into the heat exchanger where the coating solution coats the interior surface of the heat exchanger, and then through the return line to return the coating solution to the tank.

In another aspect, the disclosure can generally relate to a system for coating an interior surface of a heat exchanger where the heat exchanger is immersed in a tank of the coating solution. The system comprises a tank for storing the coating solution, a masking box comprising a masking box inlet and a masking box outlet, the masking box configured to contain the heat exchanger such that a heat exchanger inlet couples to the masking box inlet and a heat exchanger outlet couples to the masking box outlet. A source line is configured to be coupled to the masking box inlet and a return line is configured to be coupled to the masking box outlet. A pump is attached to the source line and configured to pump the coating solution through the source line, through the masking box inlet and through the heat exchanger inlet where the coating solution coats the interior surface of the heat exchanger. The pressure of the pump forces the coating solution through the heat exchanger, through the heat exchanger outlet, through the masking box outlet, and through the return line to the tank.

In yet another aspect, the disclosure can generally relate to a method for coating an interior surface of a heat exchanger, the method comprising: attaching a heat exchanger inlet to a source line, the source line coupled to a pump; attaching a heat exchanger outlet to a return line, the return line feeding a tank; and treating the interior surface of the heat exchanger with a coating solution by pumping the coating solution with the pump through the source line, through the heat exchanger, and through the return line to the tank.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
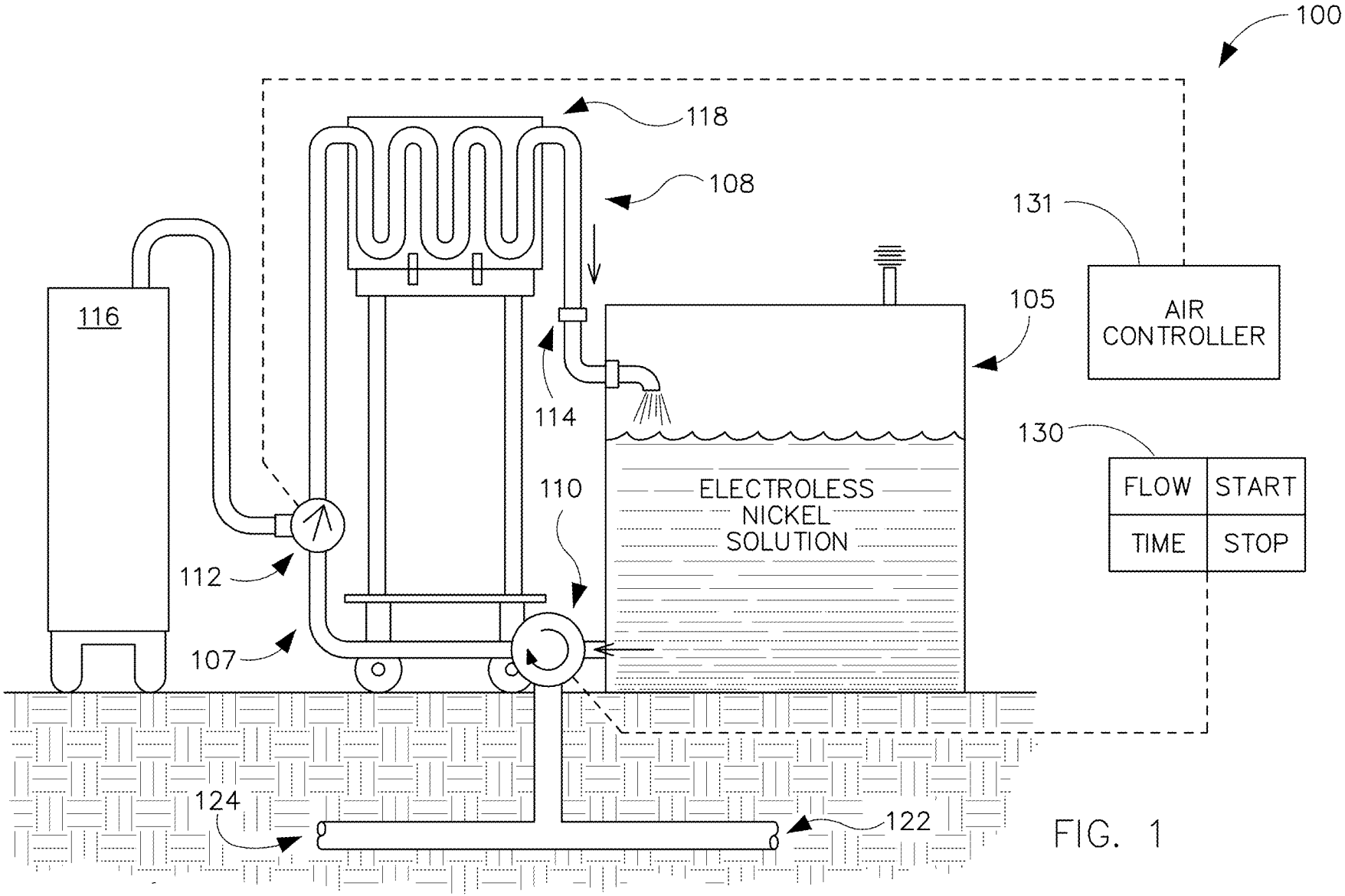
FIG. 1 illustrates a system for coating the interior surface of a heat exchanger in accordance with a first example embodiment of the disclosure.

In general, example embodiments provide systems and methods for coating an interior surface of a heat exchanger with a coating material that resists formation of mineral scale deposits. Heat exchangers typically have complex geometries consisting of many turns or folds in order to optimize the heat exchanger's heat transfer efficiency. However, the complex geometries of heat exchangers make it difficult to coat the interior surfaces of the heat exchanger with a protective coating. One approach can be to coat the interior surface of components of the heat exchanger before the components are assembled into the completed heat exchanger. However, this approach can present challenges in that joining the components of the heat exchanger, after coating, into the completed heat exchanger typically requires a brazing or soldering process that can, in some instances, damage the coating on the interior surface of the heat exchanger components.

Another approach is to immerse the entire completed heat exchanger in a coating solution. Once the heat exchanger is immersed in the coating solution, the coating solution can attach to the interior and exterior surfaces of the completed heat exchanger. However, this approach has disadvantages in that the coating solution is not needed on the exterior surfaces of the heat exchanger because the exterior surfaces are not exposed to the water containing the minerals. Therefore, this approach is wasteful in that the coating solution is unnecessarily applied to the exterior surfaces of the heat exchanger. Additionally, immersing the completed heat exchanger in the coating solution may not achieve a uniform coating, particularly along the interior surfaces of the heat exchanger.

Accordingly, an alternate approach that involves applying a protective coating only to the interior surface of the complete heat exchanger is preferable. In particular, an approach providing for a coating solution to be pumped into the heat exchanger is preferable to the previously described approaches in that it is not wasteful and a more consistent coating is applied to the interior surface of the heat exchanger.

Mineral scale deposits tend to form along the interior surface of the copper tubing in a heat exchanger, particularly when the copper tubing is heated. However, a protective coating can inhibit the formation of mineral scale deposits along the interior surface of the heat exchanger. A coating that is thermally conductive is the preferred choice so as to minimize any detrimental affect the coating may have on the thermal efficiency of the heat exchanger. Accordingly, coating solutions that deposit a thermally conductive coating on the interior surface of the heat exchanger are preferable. For example, the coating solutions can include a metallic component, such as nickel, which will react with the copper tubing of the heat exchanger and form a protective coating on the interior surface of the heat exchanger. Example coating solutions can include one or more various chemical additives along with the nickel, such as phosphorus, silicon carbide, boron nitride, and PTFE materials. Example embodiments described herein use an electroless nickel solution whereby the solution reacts with the material of the heat exchanger to deposit nickel on the interior surface of the heat exchanger. An electroless nickel solution approach contrasts with electroplating wherein an electric current is required to deposit nickel on a surface. In addition to inhibiting scale deposits, coatings formed with an electroless nickel solution are advantageous for the interior surfaces of heat exchangers because they are wear-resistant and provide a low coefficient of friction. The following are examples of electroless nickel coating solutions which can be used to coat the interior surface of a heat exchanger.

1. META-PLATE 3000 nickel solution supplied by Metal Chem, Inc. provides a coating that is 1-4 wt % phosphorus with the remainder of the deposited coating being nickel. This solution is particularly advantageous for providing a coating that can withstand high temperatures, such as those encountered when brazing heat exchanger components together.
2. META-PLATE 3500 nickel solution supplied by Metal Chem, Inc. provides a coating that is 3-6 wt % phosphorus with the remainder of the deposited coating being nickel. This solution provides a coating that is stable at lower temperatures than those encountered in brazing.
3. META-PLATE 6000 nickel solution supplied by Metal Chem, Inc. provides a coating that is 6-8 wt % phosphorus with the remainder of the deposited coating being nickel. This solution is particularly advantageous for providing a coating that requires corrosion and wear resistance.
4. META-PLATE 2500 nickel solution supplied by Metal Chem, Inc. provides a coating that is 10.6-12 wt % phosphorus with the remainder of the deposited coating being nickel. This solution is particularly advantageous for providing a coating that requires ductility, solderability, and corrosion resistance.
5. ENOVA EF KR nickel solution supplied by Coventya provides a coating that is 36 wt % phosphorus, 6-8 wt % boron nitride, and the remainder of the deposited coating being nickel. This solution is particularly advantageous for providing a coating that requires corrosion and wear resistance as well as lubricity.

It should be understood that in alternate embodiments, thermally conductive materials other than nickel and solutions other than foregoing examples can be used to form the protective coating. Similarly, although copper is mentioned as the material for the heat exchanger tubing, in alternate embodiments the heat exchanger can be made from other materials that efficiently conduct heat including stainless steel and other metal alloys.

Coating systems are described herein that allow uniform coatings to be applied to the interior surface of heat exchangers in a large scale production environment. The heat exchangers produced using the example systems and methods described herein can be used in a variety of water heater appliances and applications. Further, the heat exchangers produced using the example embodiments described herein can be used in any type of environment (e.g., warehouse, attic, garage, storage, mechanical room, basement) for any type (e.g., commercial, residential, industrial) of water heating appliance. Water heaters used with the example embodiments of heat exchangers described herein can be used for one or more of any number of processes (e.g., automatic clothes washers, automatic dishwashers, showers, sink faucets, heating systems, humidifiers, pool heating equipment, space heating boilers, etc.).

Coating systems for heat exchangers described herein can be made of one or more of a number of suitable materials to allow that device and/or other associated components of a system to meet certain standards and/or regulations while also maintaining durability in light of the one or more conditions under which the devices and/or other associated components of the system can be exposed. Examples of such materials can include, but are not limited to, aluminum, stainless steel, copper, fiberglass, glass, plastic, PVC, ceramic, and rubber.

Components of coating systems for heat exchangers (or portions thereof) described herein can be made from a single piece (as from a mold, injection mold, die cast, or extrusion process). In addition, or in the alternative, coating systems for heat exchangers (or portions thereof) can be made from multiple pieces that are mechanically coupled to each other. In such a case, the multiple pieces can be mechanically coupled to each other using one or more of a number of coupling methods, including but not limited to epoxy, welding, soldering, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

In the foregoing figures showing example embodiments of coating systems for heat exchangers, one or more of the components shown may be omitted, repeated, and/or substituted. Accordingly, example embodiments of coating systems for heat exchangers should not be considered limited to the specific arrangements of components shown in any of the figures. For example, features shown in one or more figures or described with respect to one embodiment can be applied to another embodiment associated with a different figure or description. As another example, optional components such as the air compressor described below can be omitted.

In addition, if a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Terms such as "first", "second", "third", "top", "bottom", "side", and "within" are used merely to distinguish one component (or part of a component or state of a component) from another. Such terms are not meant to denote a preference or a particular orientation, and are not meant to limit embodiments of automatic descaling systems for water heaters. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

"Connection," as used herein, refers to directly connected or connected through another component. "Fluidly connected," as used herein, refers to components that are directly connected or connected through another component and can also move a fluid between them. For example, a valve and a pump can be fluidly connected through a line. If a valve is located between two fluidly connected components, the components are still considered fluidly connected as long a fluid path is possible. "Lines" as use herein refers to a fluid tight tube such as a pipe.

Referring now to the figures, FIG. 1 illustrates an example coating system 100 for coating the interior surface of a heat exchanger in accordance with the embodiments of this disclosure. The coating system 100 includes a tank 105 of a coating solution, which in this case is a nickel-based solution. The tank 105 is coupled to a pump and valve assembly 110 and a source line 107 which feed the coating solution to a heat exchanger 118. The valve portion of the pump and valve assembly 110 can permit other lines to attach to the source line 107. For instance, in certain embodiments, a pre-treatment line 122 and a water line 124 may be coupled to the source line 107 via a valve portion of the pump and valve assembly 110. The operation of the pump and valve assembly 110 can be controlled by a controller, such as pump controller 130 shown in FIG. 1.

At an end opposite the tank 105, the source line 107 is coupled to a heat exchanger inlet of the heat exchanger 118. A heat exchanger outlet of the heat exchanger 118 is coupled to a return line 108 which returns the coating solution to tank 105. In the example coating system 100 shown in FIG. 1, the heat exchanger 118 is mounted on an optional rack holder. The example coating system 100 shown in FIG. 1 also shows an optional air compressor 116 attached to the source line 107. In alternate embodiments of the coating system, the optional components can be omitted or the components may be placed in a different arrangement.

During operation of the coating system 100, the pump 110 can pump a fluid through the source line 107 to the heat exchanger 107. In one example embodiment, the pump controller 130 can control the pump and valve assembly 110 to supply water via water line 124 and source line 107 to rinse the interior of the heat exchanger to ensure it is clean before applying the coating solution. As another option, the pump controller 130 can control the pump and valve assembly 10 to supply a pre-treatment solution to the interior of the heat exchanger via pre-treatment line 122 and source line 107. The pre-treatment solution can be a solution that facilitates bonding between the interior surface of the heat exchanger 118 and the coating solution that will follow the pre-treatment solution through the heat exchanger 118. The return line 108 can include a quick connection point 114 for attaching additional lines for draining the water or pre-treatment solution so that the water or pre-treatment solution is not mixed with the coating solution in tank 105. It should be understood that the use of the water or the pre-treatment solution prior to pumping the coating solution is optional and alternate embodiments may not use the water rinse or the pre-treatment solution prior to applying the coating solution.

As a next step in the process, the pump and valve assembly 110 pumps the coating solution from tank 105 through the source line 107 to the heat exchanger inlet. Once inside the heat exchanger 118, the coating solution is designed to react with the interior surface of the heat exchanger and form a protective coating thereon. In certain embodiments, the coating solution may be held within the heat exchanger 118 for a predefined period of time to permit the protective coating to form on the interior surface of the heat exchanger 118. For instance, the combination of the pump 110 and a valve (not shown) in the return line 108 can be used to hold the coating solution within the heat exchanger 118 for a period of time. Maintaining the coating solution under pressure within the heat exchanger for a period of time can facilitate creating a uniform protective coating throughout the interior surface of the heat exchanger 118.

After the coating solution has had sufficient time to form a protective coating on the interior surface of the heat exchanger 118, the controller can open the valve (if present) in the return line 108 and the remaining coating solution, that has not attached to the interior surface as the protective coating, is returned to the tank 105 via return line 108. After application of the coating solution, as an optional step, a rinse of water or another solution can be pumped through the heat exchanger 118 to wash out any remaining coating solution that has not attached to the interior surface of the heat exchanger 118. As another optional step, the controller can activate the air compressor 116 to force air through the heat exchanger 118 to remove any remaining water or other material. The air compressor 116 can be attached to the source line 107 at quick connection point 112. Once the coating process is completed, the heat exchanger 118 with its protective interior coating is ready for installation in a water heating appliance.

Figure 2:
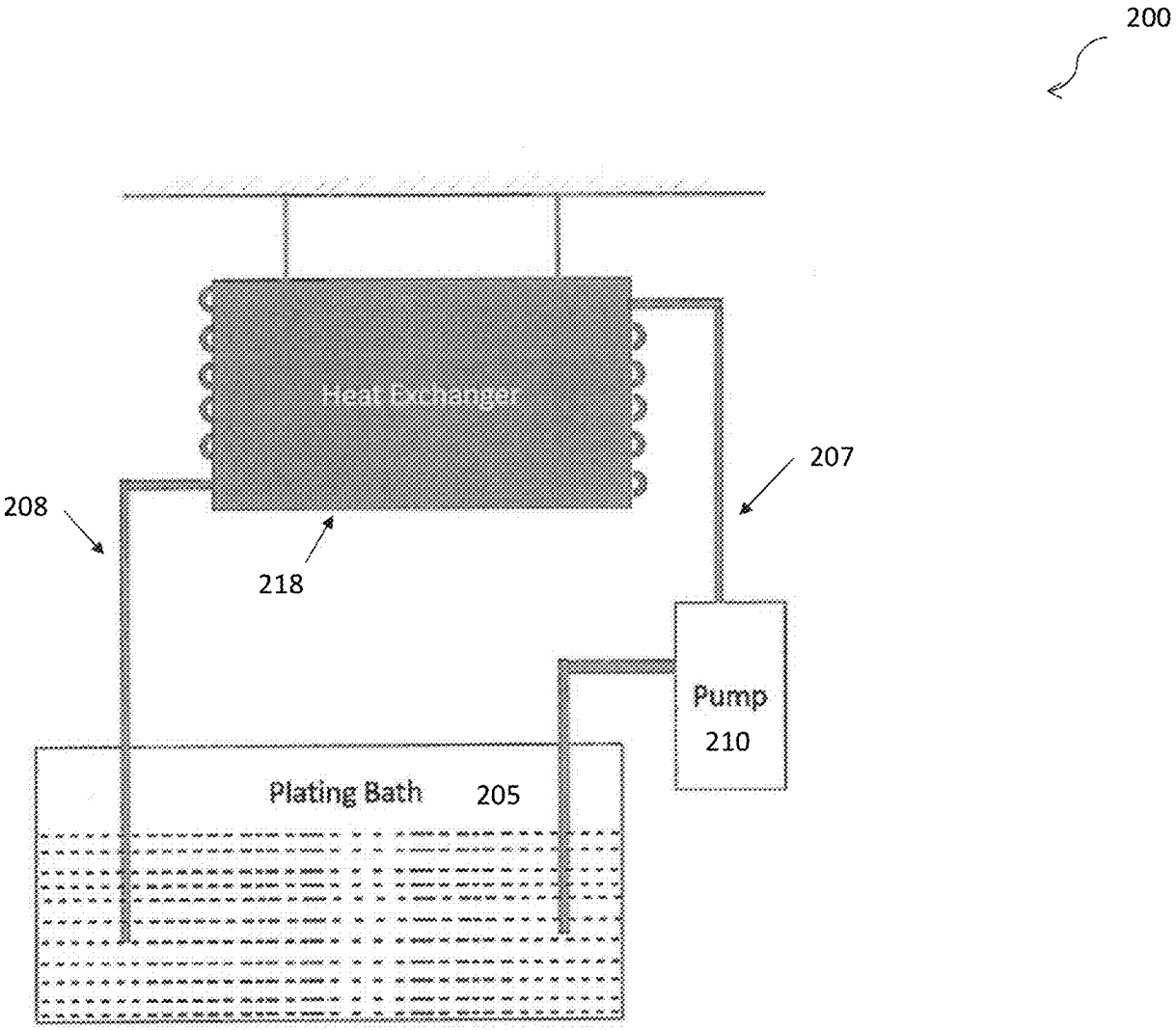
FIG. 2 illustrates a system for coating the interior surface of a heat exchanger in accordance with a second example embodiment of the disclosure.

FIG. 2 illustrates an alternate example embodiment of a coating system 200. Coating system 200 is similar to coating system 100 of FIG. 1, but coating system 200 eliminates certain of the optional components shown in FIG. 1. Coating system 200 includes a tank 205 containing a coating solution and a pump 210 that forces the coating solution through a source line 207 and through a heat exchanger 218. Similar to the example coating system of FIG. 1, the coating solution forms a protective coating on the interior surface of the heat exchanger 218 and then the remaining coating solution is returned to the tank 205 via return line 208. Once the protective coating is formed on the interior surface of the heat exchanger 218, the heat exchanger is ready for installation in a water heating appliance.

Referring now to FIGS. 3A, 3B, 4, 5, and 6, another example embodiment of a coating system 300 is illustrated. Coating system 300 differs from coating systems 100 and 200 in that in coating system 300 the heat exchanger is placed within a masking box and is immersed in the coating solution. Coating system 300 comprises a tank 305 that includes a top 304, sidewalls 303, an inlet 302, and a drain 354. The tank 305 can be filled with a coating solution that is applied to the interior surfaces of heat exchanger. As an option in the embodiment shown in FIG. 3B, the tank 305 can be mounted on a stand 352 and can include an external pump 350 configured to pump fluid into the tank 305.

Figure 3A:
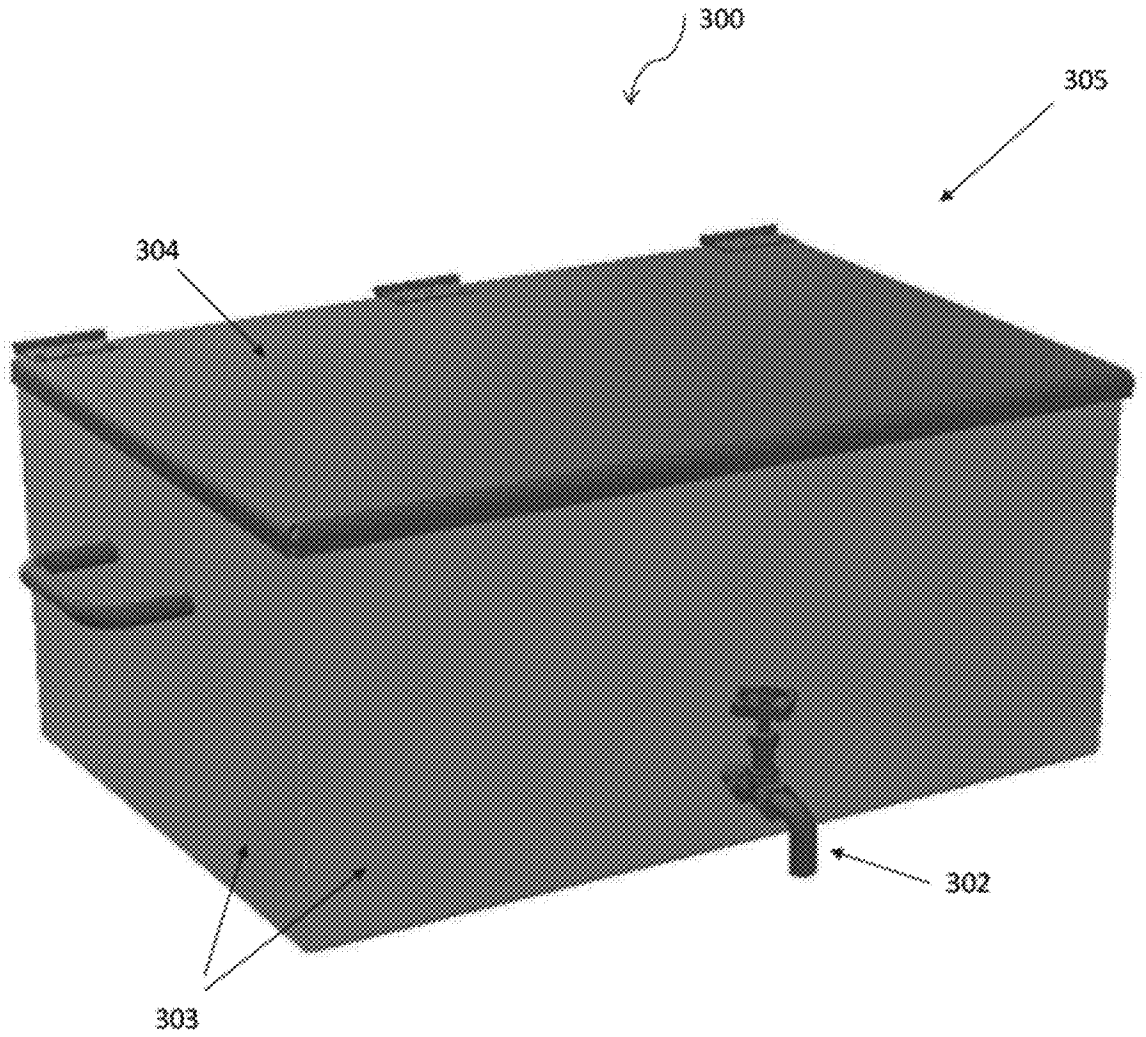
FIGS. 3A, 3B, 4, 5, and 6 illustrate a system for coating the interior surface of a heat exchanger in accordance with a third example embodiment of the disclosure.
Figure 3B:
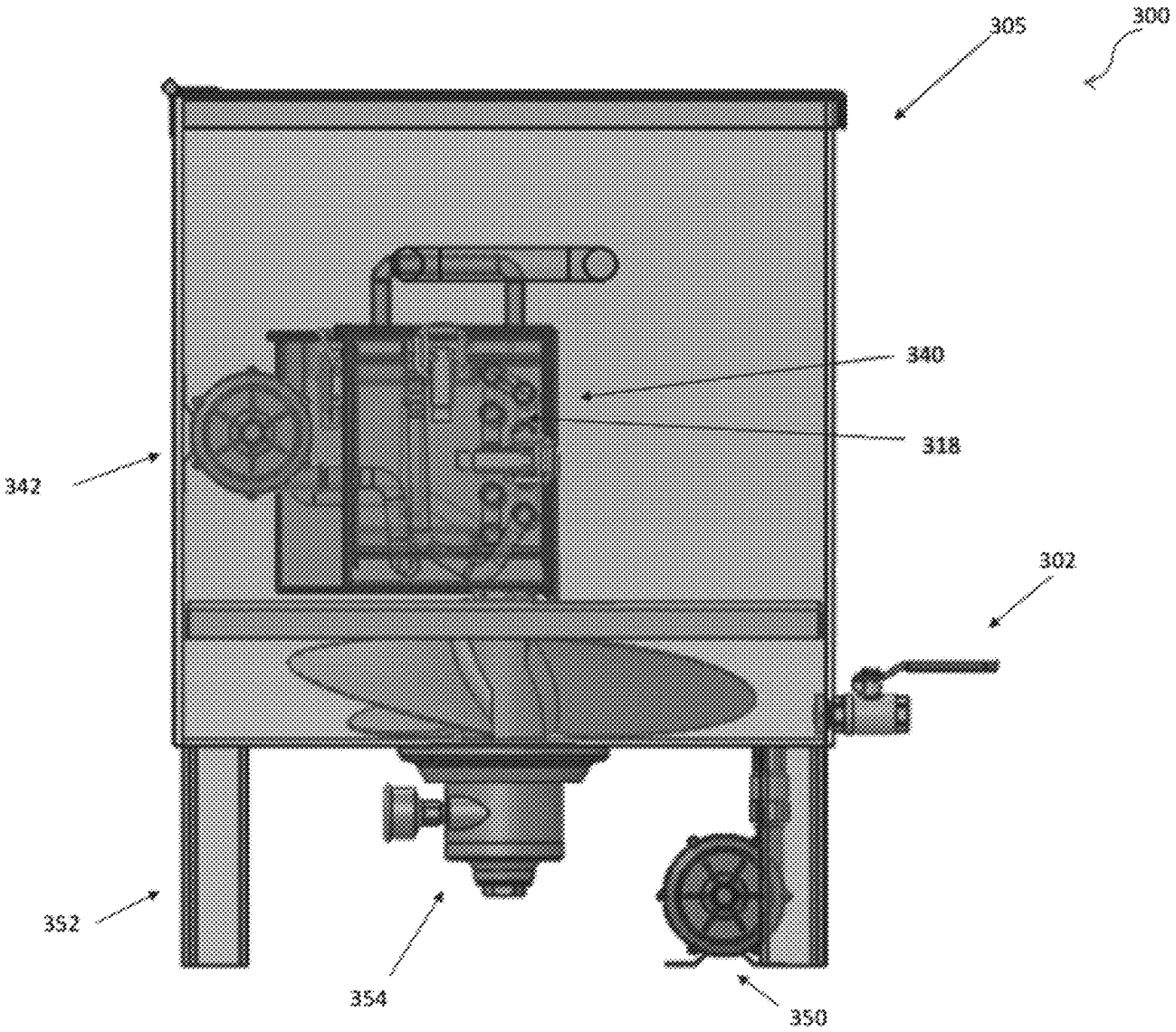
Figure 4:
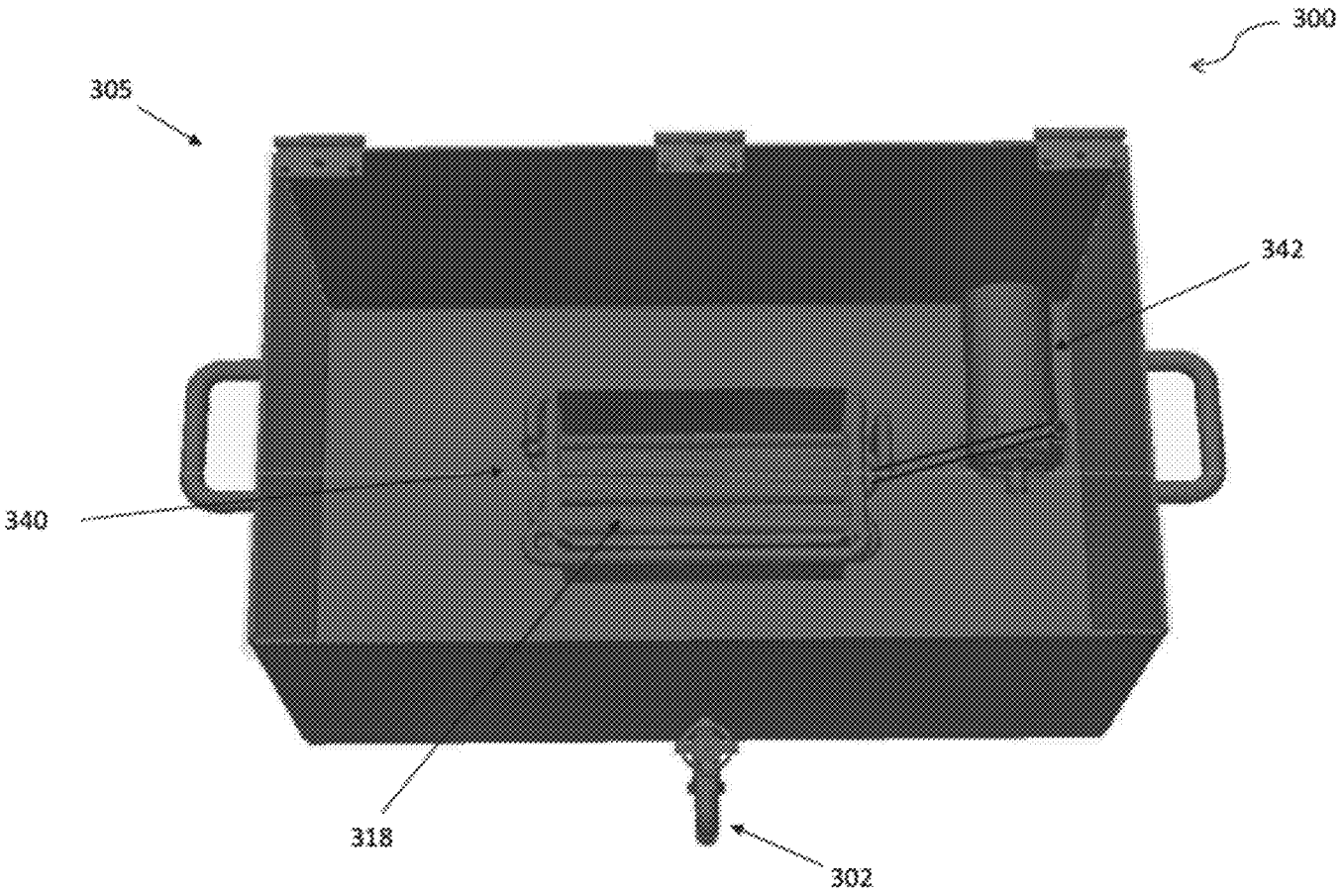
Figure 5:
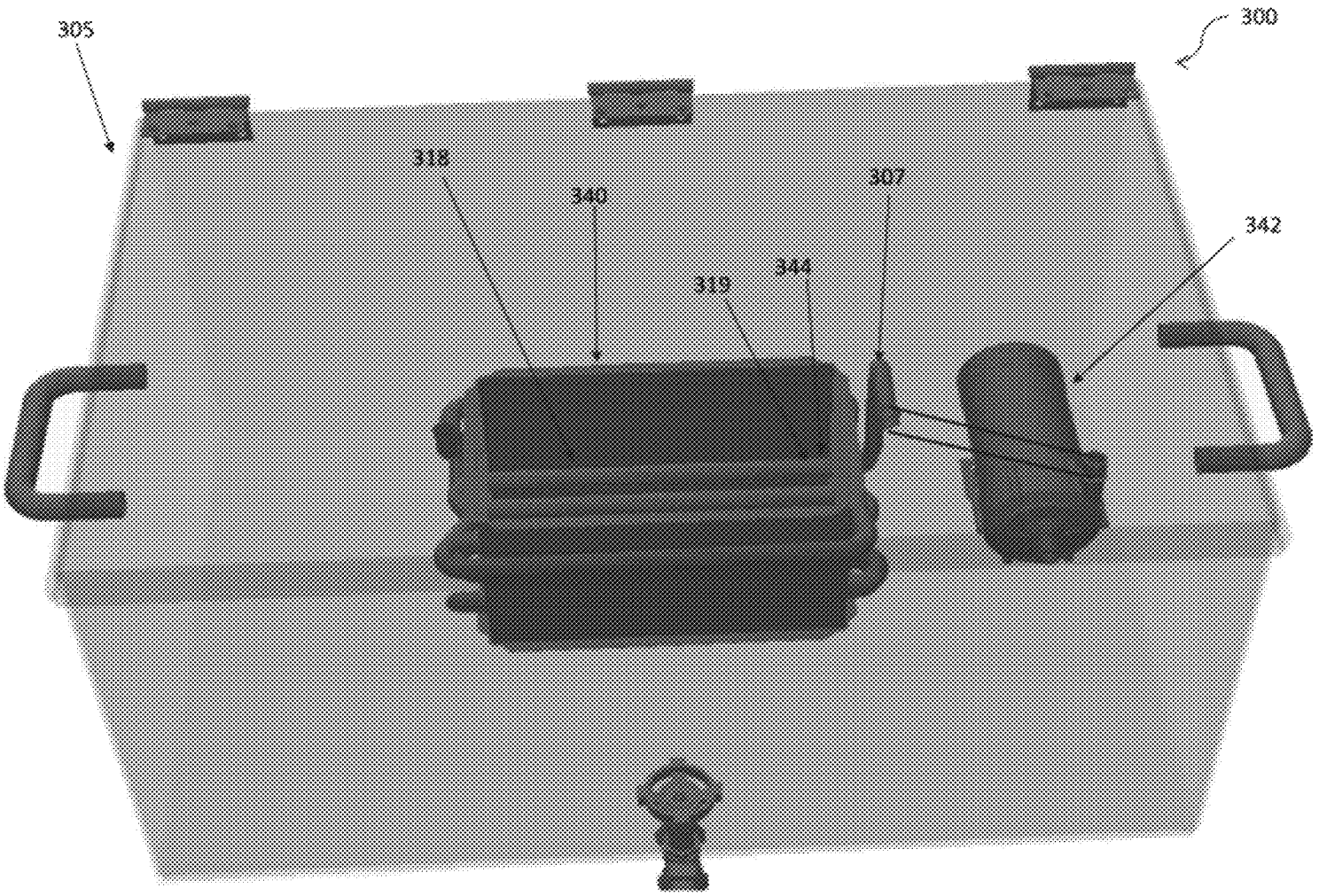
Figure 6:
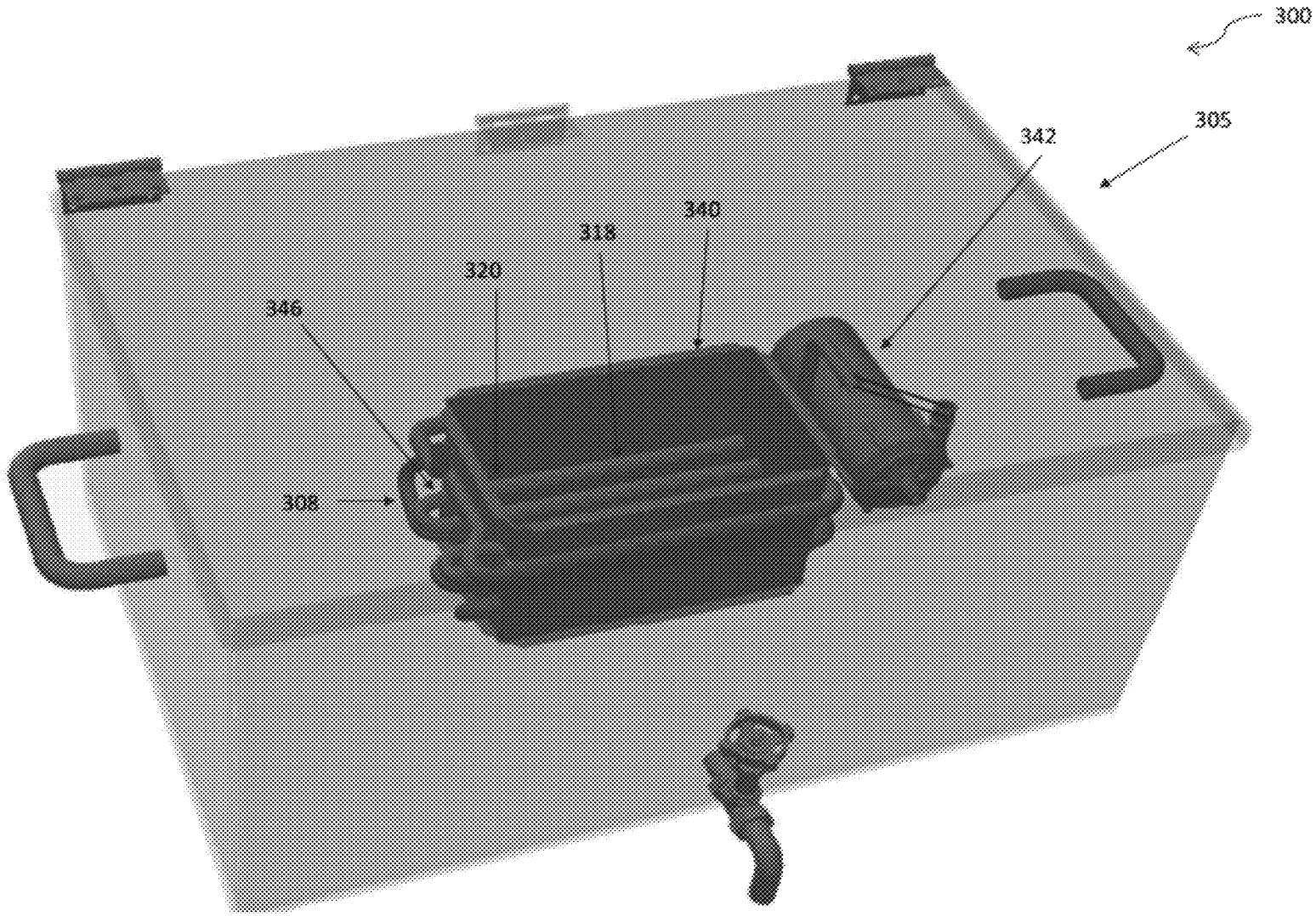

The coating system 300 further includes internal pump 342 which attaches to masking box 340. As shown in FIGS. 3B, 4, 5, and 6, a heat exchanger 318 is placed within masking box 340 and masking box 340 is immersed in the coating solution within tank 305. In FIG. 3B, the walls of the tank 305 and the masking box 340 are shown as semitransparent so that the heat exchanger 318 is visible within the masking box 340. In FIGS. 5 and 6, the walls of the tank 305 are shown as semi-transparent so that the masking box 340 and heat exchanger 318 are visible. The masking box 340 is designed so that coating solution only flows through the interior of the heat exchanger 318 and not around the outside of the heat exchanger 318. In certain embodiments, the masking box 340 can have an open top, as shown in FIGS. 4, 5, and 6, and the level of the coating solution in the tank 305 is maintained below the top of the masking box 340 so that coating solution does not spill into the masking box 340. In other embodiments, the masking box 340 can have a top that seals and isolates the interior of the masking box 340 from the coating solution in which it is immersed.

As shown in FIGS. 5 and 6, the masking box 340 can be attached to a source line 307 and a return line 308. The source line 307 is coupled at one end to internal pump 342 and at the other end to a masking box inlet 344. The return line 308 is coupled at one end to a masking box outlet 346 and the other end of the return line empties the coating solution back into the tank 305. The heat exchanger 318 is inserted into the masking box 340 such that a heat exchanger inlet 319 attaches to the masking box inlet 344 and a heat exchanger outlet 320 attaches to the masking box outlet 346.

When the coating system 300 is operating, the masking box 340 containing the heat exchanger 318 can be placed into the tank 305 and the coating solution can be fed into the tank 305 with the external pump 350 and inlet 302 or via another means such as a gravity feed. Alternatively, the tank 305 may already contain the coating solution when the masking box 340 containing the heat exchanger 318 is placed into the tank 350. The masking box 340 is attached to the source line 307 and the return line 308 as described previously and then the internal pump 342 can begin pumping the coating solution from the tank through the heat exchanger 318. Specifically, the internal pump 342 pumps the coating solution sequentially through the source line 307, through the masking box inlet 344, and through the heat exchanger inlet 319 so that the coating solution can coat the interior of the heat exchanger 318 without contacting the exterior of the heat exchanger 318. In certain examples, the coating solution can remain within the heat exchanger 318 for a certain period of time to permit the protective coating to attach uniformly to the interior surface of the heat exchanger 318. The internal pump 342 can then force the remaining coating solution, that has not attached to the interior surface of the heat exchanger 318, sequentially through the heat exchanger outlet 320, through the masking box outlet 346, and through the return line 308 where the remaining coating solution empties into the tank at the outlet of the return line 308. While not shown in FIGS. 3A-6, a controller, such as the controller described in connection with FIG. 7, can automate and control the operation of the coating system 300.

Figure 7:
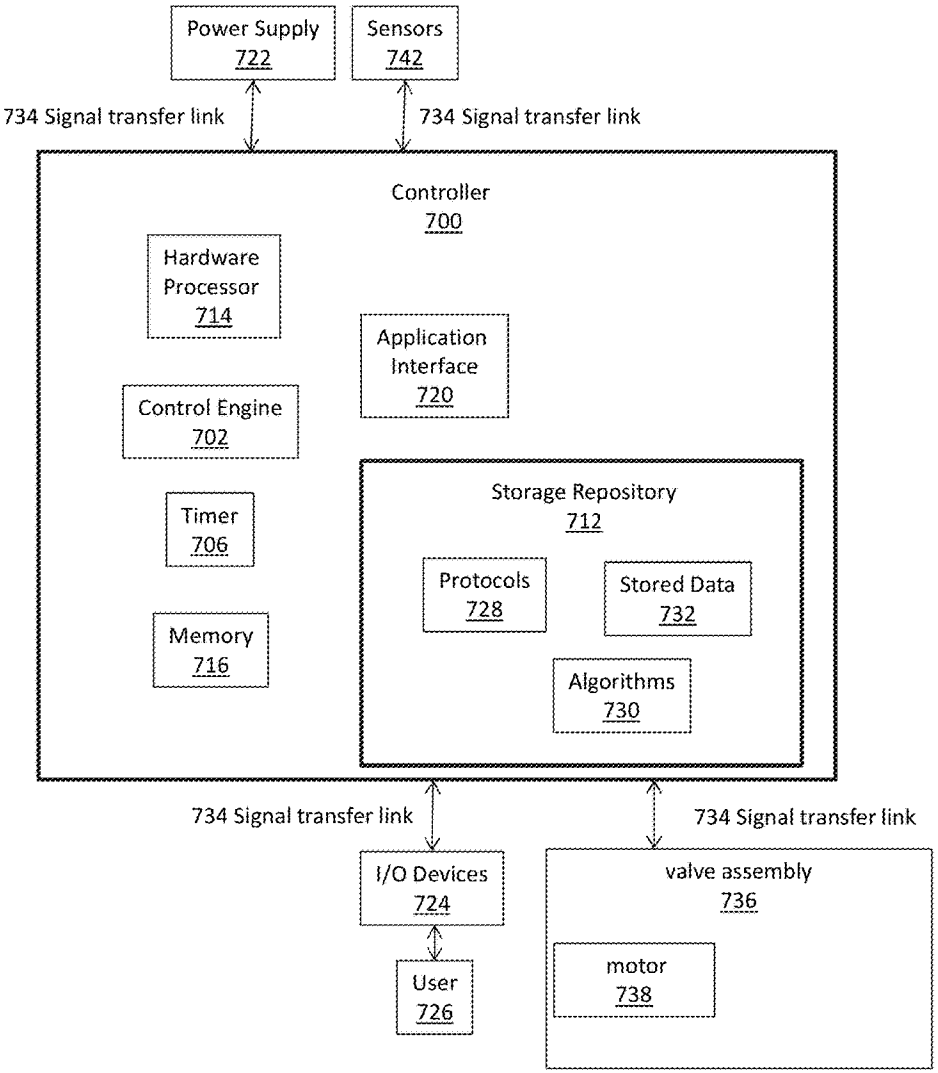
FIG. 7 illustrates an example controller for use with the example embodiments of the disclosure.

As previously referenced, the example coating systems of the present disclosure may include a controller. FIG. 7 illustrates an example embodiment of a controller for operating a coating system. For example, controller 700 can take the place of pump controller 130 and/or air compressor controller 131 shown in FIG. 1. The components of the controller 700, can include, but are not limited to, a control engine 702, a timer 706, a storage repository 712, a hardware processor 714, a memory 716, and an application interface 720. FIG. 7 also illustrates example connections of the controller 700 to one or more input/output (I/O) devices 724, a user 726, sensors 742, valve assemblies 736, and a power supply 722. A bus (not shown) can allow the various components and devices to communicate with one another. A bus can be one or more of any of several types of bus structures, including a memory bus or memory controller, a peripheral bus, an accelerated graphics port, and a processor or local bus using any of a variety of bus architectures. The components shown in FIG. 7 are not exhaustive, and in some embodiments, one or more of the components shown in FIG. 7 may not be included in an example system. Further, one or more components shown in FIG. 7 can be rearranged.

A user 726 may be any person or entity that interacts with a coating system and/or the controller 700. Examples of a user 726 may include, but are not limited to, an engineer, an appliance or process, an electrician, an instrumentation and controls technician, a mechanic, and an operator. There can be one or multiple users 726. The user 726 can use a user system (not shown), which may include a display (e.g., a GUI). The user 726 can interact with (e.g., sends data to, receives data from) the controller 700 via the application interface 720 (described below) and can also interact with other components including the sensors 742 and/or the power supply 722. Interaction between the user 726, the controller 700, the sensors 742, the valve assembly 736, and the power supply 722 can be conducted using signal transfer links 734.

Each signal transfer link 734 can include wired (e.g., Class 1 electrical cables, Class 2 electrical cables, electrical connectors, electrical conductors, electrical traces on a circuit board, power line carrier, DALI, RS485) and/or wireless (e.g., Wi-Fi, visible light communication, cellular networking, Bluetooth, WirelessHART, ISA100) technology. For example, a signal transfer link 734 can be (or include) one or more electrical conductors that are coupled to the controller 700 and to the valve assembly 736. A signal transfer link 734 can transmit signals (e.g., communication signals, control signals, data) between the controller 700, the user 726, the sensors 742, and/or the power supply 722.

The power supply 722 provides power to one or more components, such as the valve assembly 736, the controller 700, a pump, or a compressor. The power supply 722 can include one or more components (e.g., a transformer, a diode bridge, an inverter, a converter) that receives power (for example, through an electrical cable) from an independent power source external to the coating system 100 and generates power of a type (e.g., AC, DC) and level (e.g., 12V, 24V, 120V) that can be used by one or more components of the coating system.

The storage repository 712 can be a persistent storage device (or set of devices) that stores software and data used to assist the controller 700 in communicating with the user 726, the power supply 722, and other components of the coating system. In one or more example embodiments, the storage repository 712 stores one or more protocols 728, algorithms 730, and stored data 732. For example, a protocol 728 and/or an algorithm 730 can dictate when an operating cycle for the coating system is to be entered and how many cycles to run. Such protocols 728 and algorithms 730 can be based on information received from sensors 742, from data entered from a user 726, or may be static variables that are programed into the controller 700. Stored data 732 can be any data associated with a tankless water heater (including any components thereof), any measurements taken by sensors 742, time measured by the timer 706, adjustments to an algorithm 730, threshold values, user preferences, default values, results of previously run or calculated algorithms 730, and/or any other suitable data.

The storage repository 712 can be operatively connected to the control engine 702. In one or more example embodiments, the control engine 702 includes functionality to communicate with the user 726, the power supply 722, and other components of the coating system. More specifically, the control engine 702 sends information to and/or receives information from the storage repository 712 in order to communicate with the user 726, the power supply 722, and other components.

As another example, the control engine 702 can acquire the current time using the timer 706. The timer 706 can enable the controller 700 to control the components of the coating system. As yet another example, the control engine 702 can direct a sensor 742, such as a flow sensor, to measure a parameter (e.g., flow rate) and send the measurement by reply to the control engine 702. In some cases, the control engine 702 of the controller 700 can control the position (e.g., open, closed, fully open, fully closed, 50% open) of valves within the coating system.

The hardware processor 714 of the controller 700 executes software, algorithms 730, and firmware in accordance with one or more example embodiments. Specifically, the hardware processor 714 can execute software on the control engine 702 or any other portion of the controller 700, as well as software used by the user 726, or the power supply 722. The hardware processor 714 can be an integrated circuit, a central processing unit, a multi-core processing chip, SoC, a multi-chip module including multiple multi-core processing chips, or other hardware processor in one or more example embodiments. The hardware processor 714 is known by other names, including but not limited to a computer processor, a microprocessor, and a multi-core processor.

In one or more example embodiments, the hardware processor 714 executes software instructions stored in memory 716. The memory 716 includes one or more cache memories, main memory, and/or any other suitable type of memory. The memory 716 can include volatile and/or non-volatile memory.

In certain example embodiments, the controller 700 does not include a hardware processor 714. In such a case, the controller 700 can include, as an example, one or more field programmable gate arrays (FPGA), one or more insulated-gate bipolar transistors (IGBTs), and one or more integrated circuits (ICs). Using FPGAs, IGBTs, ICs, and/or other similar devices known in the art allows the controller 700 (or portions thereof) to be programmable and function according to certain logic rules and thresholds without the use of a hardware processor.

One or more I/O devices 724 allow a user to enter commands and information to the coating system, and also allow information to be presented to the user and/or other components or devices.

Various techniques are described herein in the general context of software or program modules. Generally, software includes routines, programs, objects, components, data structures, and so forth that perform particular tasks or implement particular abstract data types. An implementation of these modules and techniques are stored on or transmitted across some form of computer readable media, such as the memory 716 or storage device 712.

Figure 8:
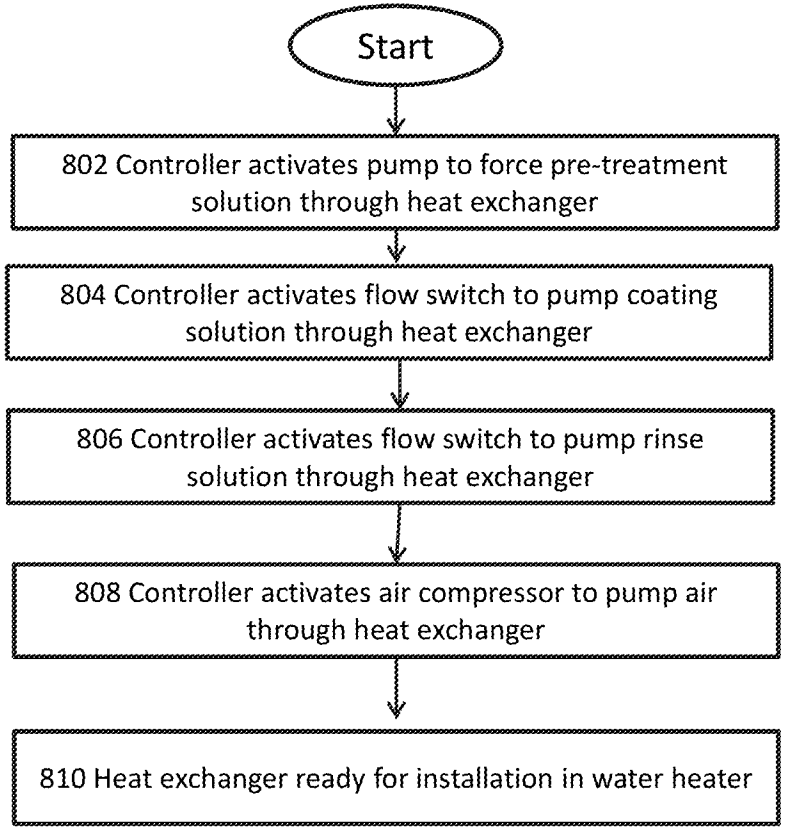
FIG. 8 illustrates an example method for coating the interior surface of a heat exchanger in accordance with an example embodiment of the disclosure.

FIG. 8 shows a flowchart describing the operation of an example embodiment of a coating system. While the various steps in the flowchart are presented and described sequentially, one of ordinary skill in the art will appreciate that some or all of the steps can be executed in different orders, combined or omitted. In addition, a person of ordinary skill in the art will appreciate that additional steps not shown in FIG. 8 can be included in performing these operations in certain example embodiments. Accordingly, the specific arrangement of steps illustrated in FIG. 8 should not be construed as limiting the scope of this disclosure. In addition, a particular computing device, such as controller 700 described in connection with FIG. 7 above, can be used to perform one or more of the steps for the methods described below in certain example embodiments.

Referring to FIG. 8, the operation of an example coating system can begin at the START step. In step 802, a controller activates a pump, such as one of pumps 110, 210, or 342, to force a pre-treatment solution through a heat exchanger that has been attached to the coating system. The pre-treatment solution can be a water solution, a cleaning solution, or a chemical solution that prepares the internal surface of the heat exchanger for application of the protective coating. In step 804, the controller activates a flow switch and the pump forces the coating solution through the heat exchanger where one or materials in the coating solution attach to the interior surface of the heat exchanger to form a protective coating. The coating solution may be permitted to reside within the heat exchanger for a certain period of time so that a uniform coating can form on the interior surface of the heat exchanger, after which the remaining coating solution exits the heat exchanger through a return line. In step 806, the controller activates a flow switch and the pump forces a rinse solution through the heat exchanger to remove any remaining coating solution that has not attached to the interior surface of the heat exchanger. Lastly, in step 808, the controller can activate an air compressor attached to the source line to pump air through the heat exchanger for the purpose of removing any remaining solution from the interior of the heat exchanger. In step 810, the heat exchanger with the interior coating is ready to be installed in a water heating appliance.

Figure 9A:
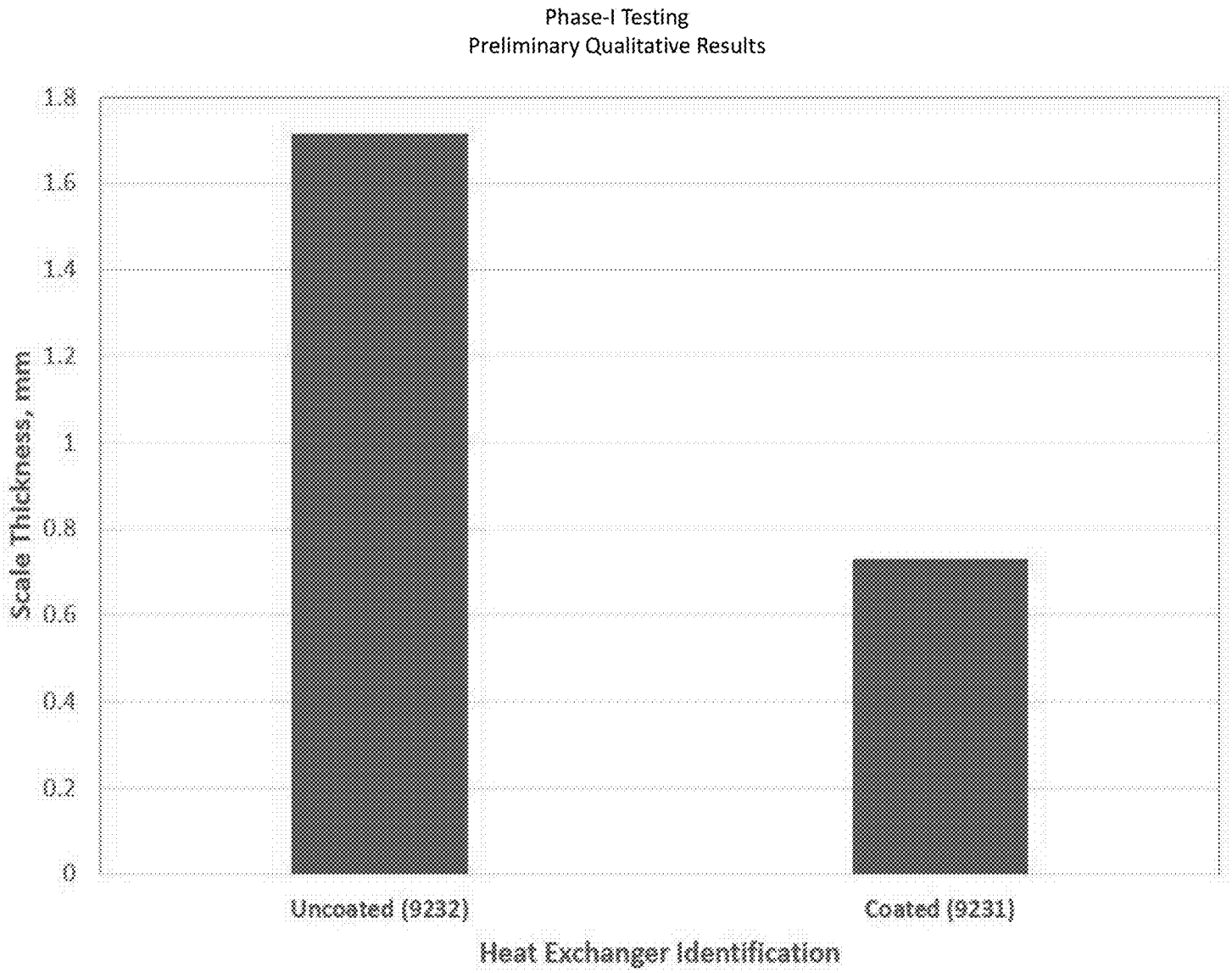
FIG. 9A is a bar graph showing experimental data collected for scale thickness measured in an uncoated heat exchanger and a coated heat exchanger.
Figure 9B:
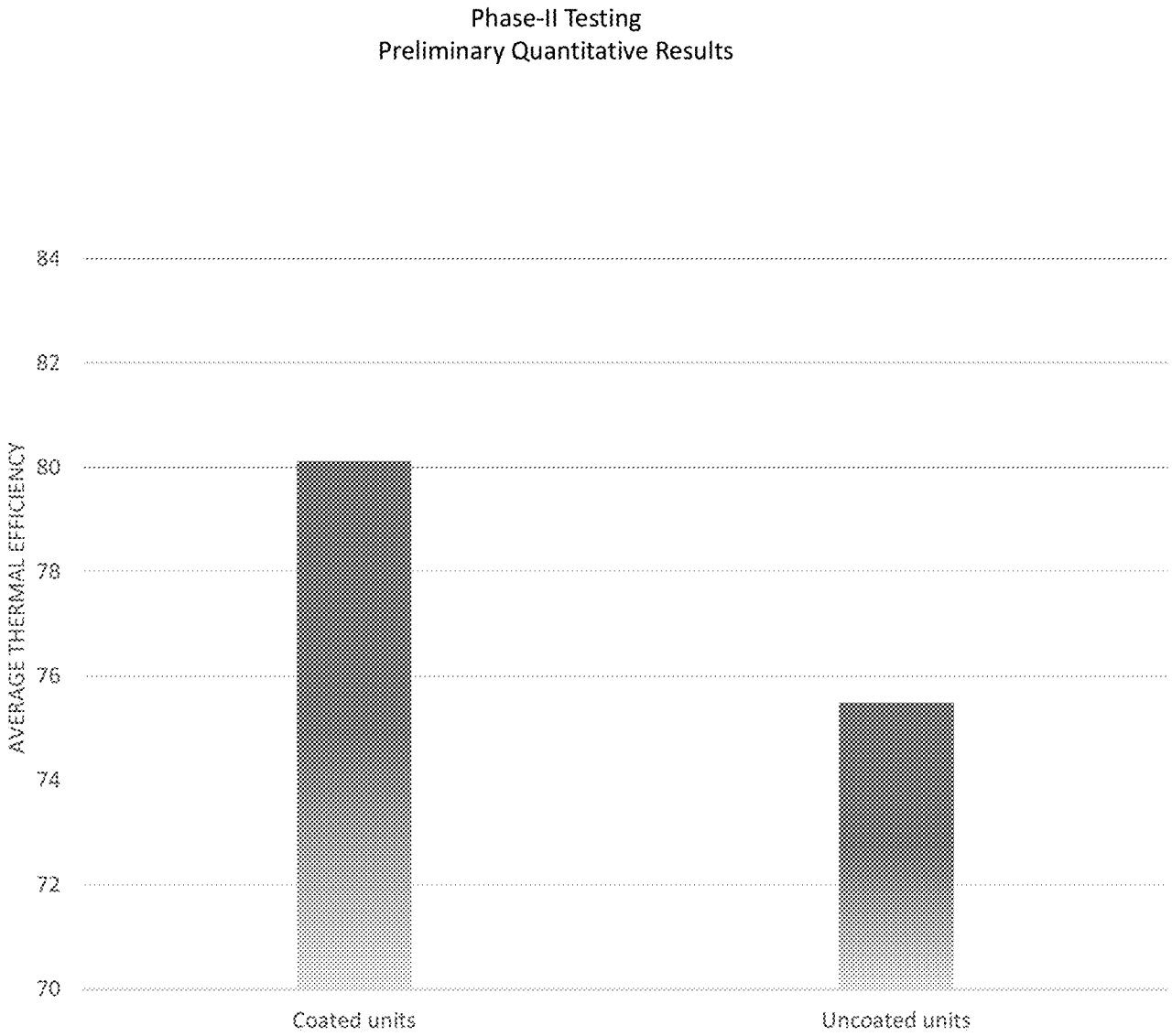
FIG. 9B is a bar graph showing experimental data collected for thermal efficiency measured in coated heat exchangers and uncoated heat exchangers.

Referring now to FIGS. 9A and 9B, testing data illustrates the benefits of the coating system. In FIG. 9A, the data shows measured mineral scale thickness that developed in an uncoated heat exchanger and in a coated heat exchanger, where the two heat exchanger had the same usage. The data indicates that the protective coating applied to the interior surface of the heat exchanger substantially reduces the thickness of the mineral scale that develops on the interior of the heat exchanger, which in turn improves the thermal efficiency of the heat exchanger. FIG. 9B shows thermally efficiency data collected for a group of heat exchangers with internal coatings and a group of heat exchangers without internal coatings. The two groups of heat exchangers were subjected to the same testing. As the data shows, the thermal efficiency of the heat exchangers with the internal protective coating had significantly better thermal efficiency than the heat exchangers without the internal protective coating.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system for coating an interior surface of a heat exchanger, the system comprising:

a tank for storing a coating solution, the tank comprising a source line and a return line;

a masking box configured to contain a heat exchanger, the heat exchanger having an outer surface comprising all exterior surfaces of the heat exchanger, and prevent the coating solution from contacting the outer surface of the heat exchanger when the masking box is immersed in the coating solution in the tank; and a pump coupled to the tank, the pump configured to force the coating solution from the source line, through the heat exchanger, and through the return line to return the coating solution to the tank.

2. The system of claim 1, further comprising a pre-treatment line configured to supply a pre-treatment solution to the pump, wherein the pre-treatment solution pre-treats the heat exchanger before treatment with the coating solution.

3. The system of claim 2, wherein the pre-treatment solution is a cleaning solution that cleans the interior surface of the heat exchanger.

4. The system of claim 2, wherein the pre-treatment solution is an activation solution that prepares the interior surface of the heat exchanger for treatment with the coating solution.

5. The system of claim 1, further comprising a water line configured to supply water to the pump, wherein the water is used to rinse the interior surface of the heat exchanger.

6. The system of claim 1, wherein the coating solution comprises a metallic component.

7. The system of claim 1, wherein the coating solution comprises nickel.

8. The system of claim 1, wherein the coating solution comprises nickel and phosphorus and produces a coating that is 1-4 wt % phosphorus with a remainder of the coating being nickel.

9. A system for coating an interior surface of a heat exchanger, the system comprising:

a tank for storing a coating solution;

a masking box comprising a masking box inlet and a masking box outlet, the masking box configured to contain a heat exchanger, the heat exchanger having an outer surface comprising all exterior surfaces of the heat exchanger, and prevent the coating solution from contacting the outer surface of the heat exchanger when the masking box is immersed in the coating solution in the tank;

a source line configured to be coupled to the masking box inlet;

a return line configured to be coupled to the masking box outlet; and a pump attached to the source line and configured to pump the coating solution through the source line, through the masking box inlet, through the heat exchanger, through the masking box outlet, and through the return line to the tank.

10. The system of claim 9, wherein the masking box further comprises a sealing mechanism to prevent the coating solution from contacting the outer surface of the heat exchanger.

11. The system of claim 10, wherein the sealing mechanism comprises a gasket and a latch.

12. The system of claim 9, wherein the pump is located within the tank.

13. The system of claim 9, wherein the tank comprises a tank inlet and a tank outlet, wherein the tank inlet can be coupled to a water source or a pretreatment solution source.

14. The system of claim 9, wherein the coating solution comprises a metallic component.

15. The system of claim 9, wherein the coating solution comprises nickel and phosphorus and produces a coating that is 1-4 wt % phosphorus with a remainder of the coating being nickel.

16. A method for coating an interior surface of a heat exchanger, the method comprising:

placing the heat exchanger in a masking box configured to contain at least a portion of the heat exchanger, wherein the heat exchanger has an outer surface comprising all exterior surfaces of the heat exchanger;

attaching a heat exchanger inlet to a source line, the source line coupled to a pump;

attaching a heat exchanger outlet to a return line, the return line feeding a tank;

treating the interior surface of the heat exchanger with a coating solution by pumping the coating solution with the pump through the source line, through the heat exchanger, and through the return line to the tank; and preventing the coating solution from contacting the outer surface of the heat exchanger when the masking box is immersed in the coating solution in the tank.

17. The method of claim 16, further comprising:

placing the masking box within the tank.

18. The method of claim 16, further comprising:

attaching a masking box inlet to the source line; and attaching a masking box outlet to the return line.

19. The method of claim 16, further comprising:

pre-treating the interior surface of the heat exchanger by pumping with the pump a pre-treatment solution through the source line and through the heat exchanger.

20. The method of claim 16, wherein the coating solution comprises nickel and phosphorus and produces a coating that is 1-4 wt % phosphorus with a remainder of the coating being nickel.

* * * * *